US007934957B1

(12) United States Patent
Nakajima et al.

(10) Patent No.: US 7,934,957 B1
(45) Date of Patent: May 3, 2011

(54) CONNECTOR WITH CIRCUIT BOARD MOUNTED GROUND PORTION

(75) Inventors: Takamitsu Nakajima, Tokyo (JP); Takeshi Shindo, Tokyo (JP); Koji Hayashi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/799,556

(22) Filed: Apr. 27, 2010

(30) Foreign Application Priority Data

Feb. 3, 2010 (JP) ..... 2010-022537

(51) Int. Cl.
*H01R 9/03* (2006.01)

(52) U.S. Cl. ..... 439/607.49; 439/495; 439/607.36; 439/607.47

(58) Field of Classification Search ..... 439/607.28, 439/607.04, 607.06, 607.07, 495, 497, 607.41, 439/607.13, 607.49, 607.47, 607.36
See application file for complete search history.

(56) References Cited

U.S. PATENT DOCUMENTS 7,134,912 B2 * 11/2006 Kamata et al. ..... 439/607.31
7,344,411 B2 * 3/2008 Ker et al. ..... 439/607.36
D626,511 S * 11/2010 Nakajima et al. ..... D13/147
D629,360 S * 12/2010 Hayashi et al. ..... D13/147
2005/0260871 A1 * 11/2005 Kamata et al. ..... 439/79
2007/0212940 A1 * 9/2007 Ker et al. ..... 439/607

FOREIGN PATENT DOCUMENTS

JP 2009-193916 8/2009

* cited by examiner

*Primary Examiner* — Hae Moon Hyeon

(74) *Attorney, Agent, or Firm* — Collard & Roe, P.C.

(57) ABSTRACT

A connector is mountable on a circuit board and matable with a mating connector inserted from a front end of the connector toward a rear end of the connector. The connector has a plurality of contacts, a holder for holding the plurality of contacts so that the plurality of contacts is arranged in a lateral direction, and a shell for covering at least part of the holder. The shell has a lower plate facing the circuit board when the connector is mounted on the circuit board. The lower plate includes a front edge, an inner back edge located away from the front edge by a predetermined distance, inner side edges connecting the inner back edge to the front edge, and a ground portion projecting frontward from the inner back edge. The inner back edge and the inner side edges define a recessed area recessed rearward from the front edge by a predetermined distance. The ground portion is connectable to the circuit board.

11 Claims, 4 Drawing Sheets

CONNECTOR WITH CIRCUIT BOARD MOUNTED GROUND PORTION

CROSS REFERENCE TO RELATED APPLICATIONS

Applicants claim priority under 35 U.S.C. §119 of Japanese Patent Application No. JP2010-022537 filed Feb. 3, 2010.

BACKGROUND OF THE INVENTION

The present invention relates to a connector mountable and fixable to a circuit board and, more particularly, to a connector matable with a mating connector connected to a cable or the like.

For example, this type of connector is disclosed in JP-A 2009-193916. JP-A 2009-193916 discloses a receptacle connector (see FIG. 4 of JP-A 2009-193916) and a plug connector as a mating connector connected to a cable, a flexible printed circuit (FPC), or the like (see FIG. 1 of JP-A 2009-193916).

The receptacle connector of JP-A 2009-193916 has ground portions connected to a ground portion of a circuit board. The ground portions of the receptacle connector extend from side portions of an upper plate of a shell toward the circuit board. This configuration forms a long path from the circuit board to a portion at which the shell of the receptacle connector is connected to a shell (mating shell) of the plug connector.

The path from the circuit board to the portion at which the shell of the receptacle connector is connected to the shell (mating shell) of the plug connector should be minimized in order to establish strong countermeasures against electromagnetic interference (EMI).

SUMMARY OF THE INVENTION

It is therefore an object of the present invention to provide a connector having a minimized path from a circuit board to a portion at which a shell is connected to a mating shell.

In order to minimize a path from a circuit board to a portion at which a shell is connected to a mating shell in a case where a mating connector is inserted from a front end of the connector, it is preferable to arrange ground portions, which are to be connected to the circuit board, on a lower plate of the shell near the front end of the shell, i.e., near a mating portion of the mating connector.

However, if the ground portions extend frontward from a front edge of the shell, the mating connector should be redesigned such that the mating connector does not interfere with the ground portions when the connector is mated with the mating connector. Such design change wastes design resources for the mating connector and also causes increase in size of the mating connector. Furthermore, if the length of the mating portion of the mating connector is increased along a direction from a front to a rear of the mating connector in order to avoid the aforementioned interference, then the signal transmission characteristics may be deteriorated.

Thus, it is desirable to achieve the aforementioned object without needs for design change of the mating connector. The present invention has been made from this point of view.

Specifically, one aspect of the present invention provides a connector mountable on a circuit board and matable with a mating connector inserted from a front end of the connector toward a rear end of the connector. The connector has a plurality of contacts, a holder for holding the plurality of contacts so that the plurality of contacts is arranged in a lateral direction, and a shell for covering at least part of the holder. The shell has a lower plate facing the circuit board when the connector is mounted on the circuit board. The lower plate includes a front edge, an inner back edge, inner side edges and a ground portion. The inner back edge is located away from the front edge by a predetermined distance. The inner side edges connect the inner back edge to the front edge. The ground portion projects frontward from the inner back edge. The inner back edge and the inner side edges define a recessed area recessed rearward from the front edge by a predetermined distance. The ground portion is connectable to the circuit board.

An appreciation of the objectives of the present invention and a more complete understanding of its structure may be had by studying the following description of the preferred embodiment and by referring to the accompanying drawings.

Figure 1:
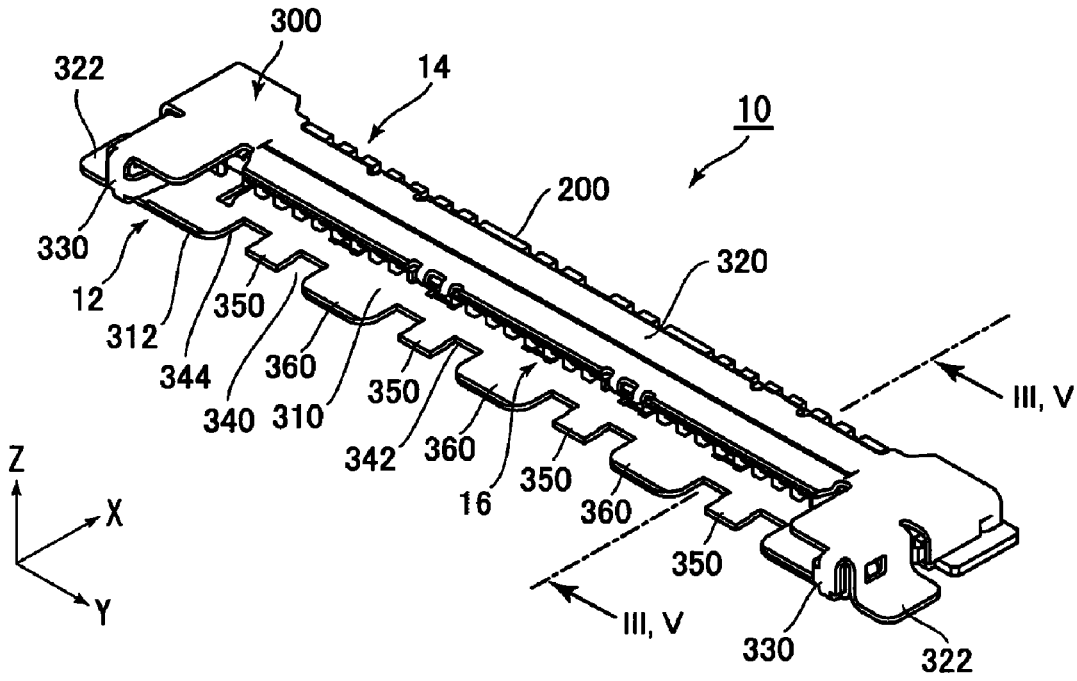
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
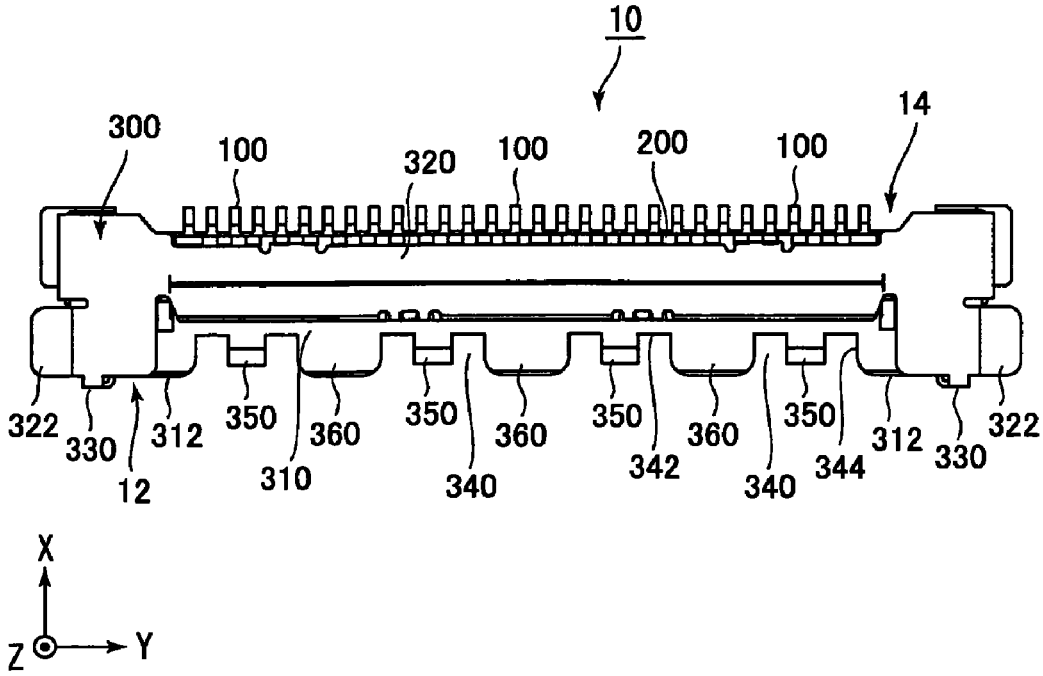
FIG. 2 is a plan view showing the connector of FIG. 1.
Figure 3:
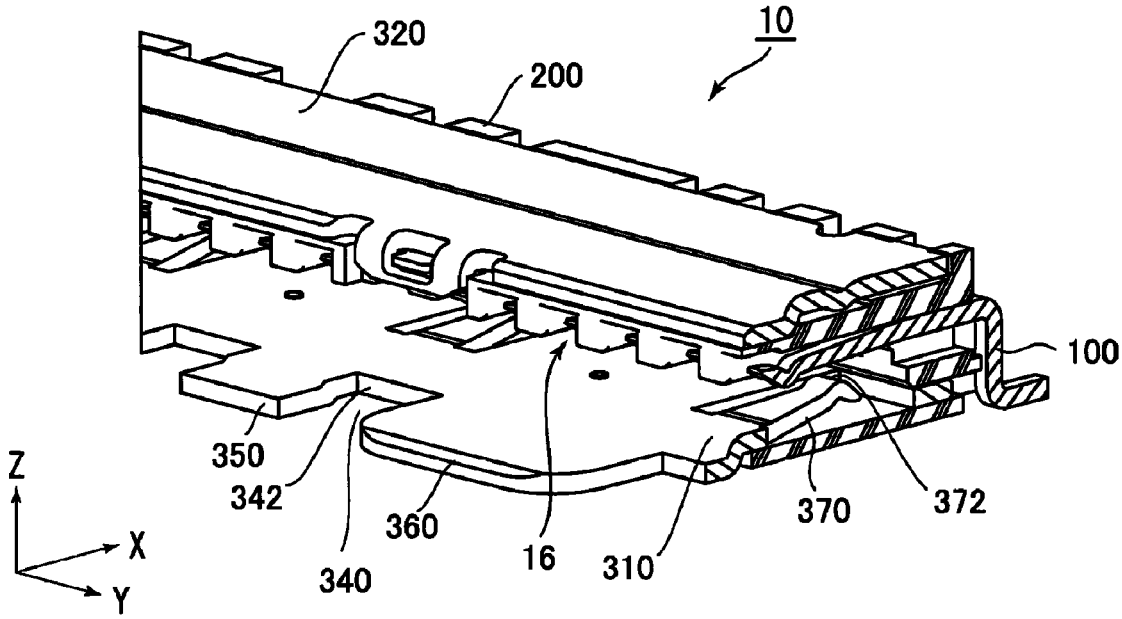
FIG. 3 is a perspective view showing the connector of FIG. 1 with a cross-section taken along line III-III.
Figure 5:
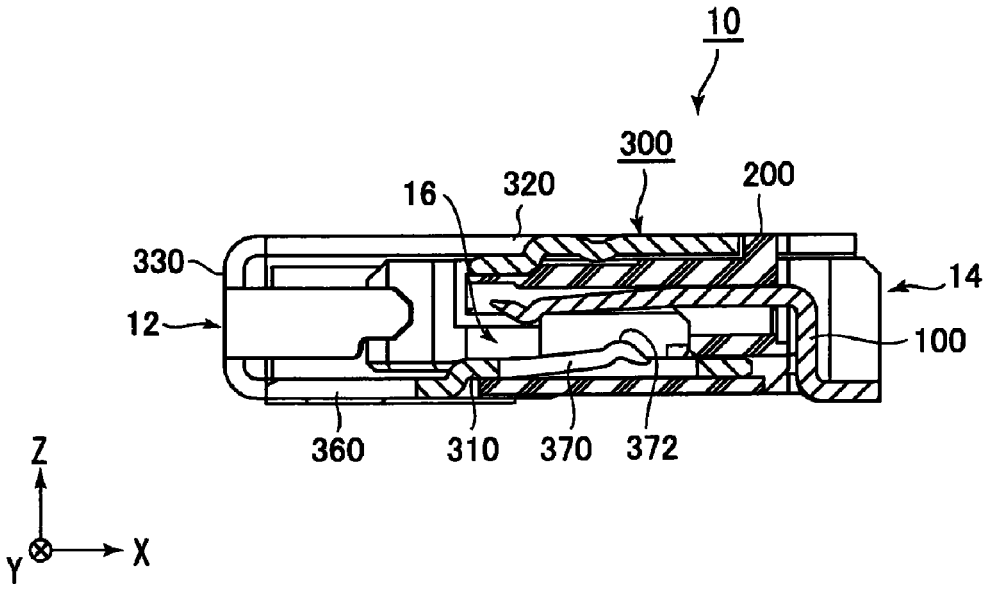
FIG. 5 is a cross-sectional view of the connector taken along line V-V of FIG. 1.

Referring to FIGS. 1 to 3 and 5, a connector 10 according to an embodiment of the present invention includes a plurality of contacts 100, a holder 200 made of an insulating material, and a shell 300 made of metal. The contacts 100 are held by the holder 200 and arranged in a lateral direction (Y-direction). The shell 300 covers at least part of the holder 200. The connector 10 according to the present embodiment is a receptacle connector mounted on a circuit board (not shown). As shown in FIGS. 1, 3, and 5, the connector 10 has a receptacle portion 16 opened toward a front end 12 of the connector 10. When a mating portion of a mating connector (plug connector), which is not shown in the drawings, is inserted into the receptacle portion 16 from the front end 12 toward a rear end 14 (along the positive X-direction), then the connector 10 is mated with and connected to the mating connector. Specifically, the mating/separation direction of the mating connector with respect to the connector 10 corresponds to a direction from the front end 12 to the rear end 14 of the connector 10 (X-direction).

Figure 4:
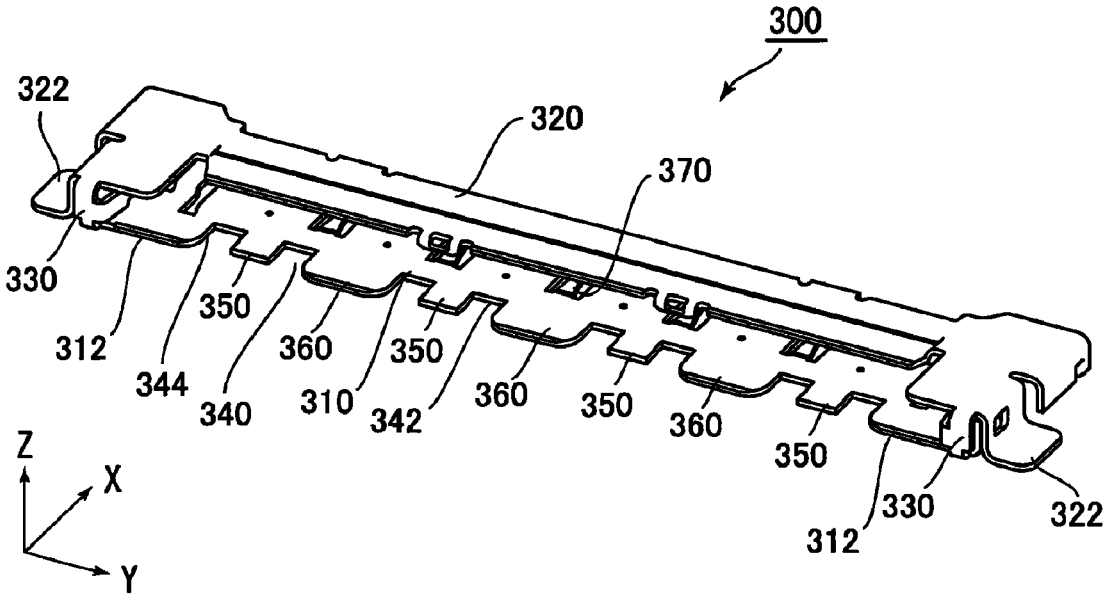
FIG. 4 is a perspective view showing a shell included in the connector of FIG. 1.

Referring to FIGS. 1 and 4, the shell 300 of this embodiment is produced by pressing a single metal sheet. The shell 300 includes a lower plate 310, an upper plate 320 and two connection parts. The lower plate 310 is located near the circuit board (not shown) when the connector 10 is mounted on the circuit board. The upper plate 320 is designed for covering at least part of an upper surface of the holder 200. The two connection parts are arranged for connecting the lower plate 310 to the upper plate 320 at opposite ends of the shell 300 in the lateral direction. The lower plate 310 faces the circuit board when the connector 10 is mounted on the circuit board.

A recessed area 340 is formed in the lower plate 310. The recessed area 340 is recessed rearward (toward the positive X-direction) from a front edge 312 of the lower plate 310 by a predetermined distance. Specifically, the recessed area 340 is defined by an inner back edge 342 located away from the front edge 312 by a predetermined distance and two inner side edges 344 connecting the inner back edge 342 to the front edge 312. The length of the inner back edge 342 is much greater than that of the inner side edges 344. Therefore, the recessed area 340 has a shape elongated in the lateral direction as shown in FIG. 2. As shown in FIG. 2, the recessed area 340 is divided into a plurality of areas by ground portions 350 and stoppers 360.

As shown in FIGS. 1, 2, and 3, the lower plate 310 includes a plurality of ground portions 350 and a plurality of stoppers 360. In the illustrated example, the lower plate 310 includes four ground portions 350 and three stoppers 360. In the present embodiment, the ground portions 350 and the stoppers 360 are arranged alternately in the lateral direction.

Figure 6:
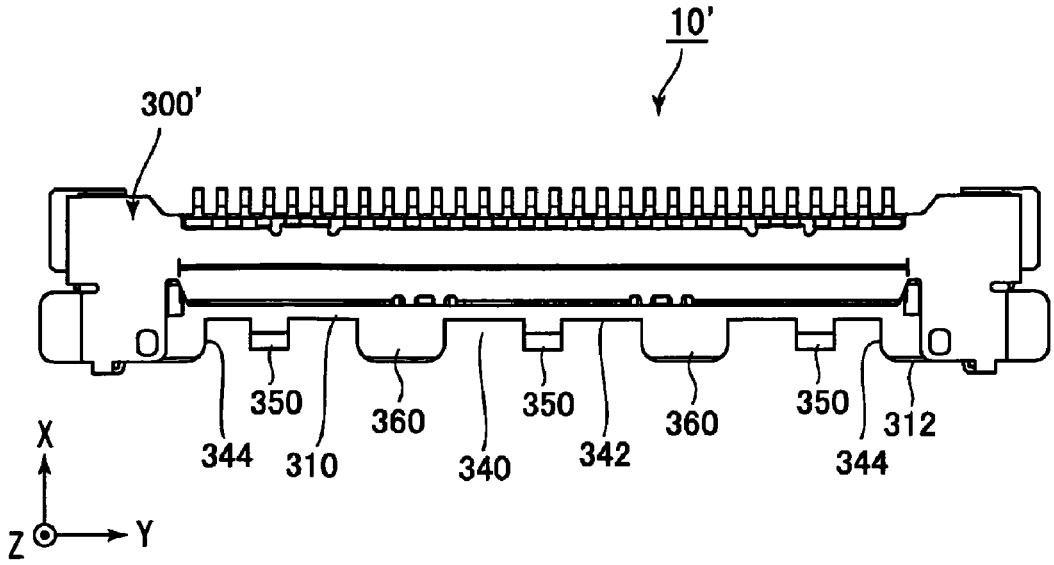
FIG. 6 is a plan view showing a variation of the connector of FIG. 2.
Figure 7:
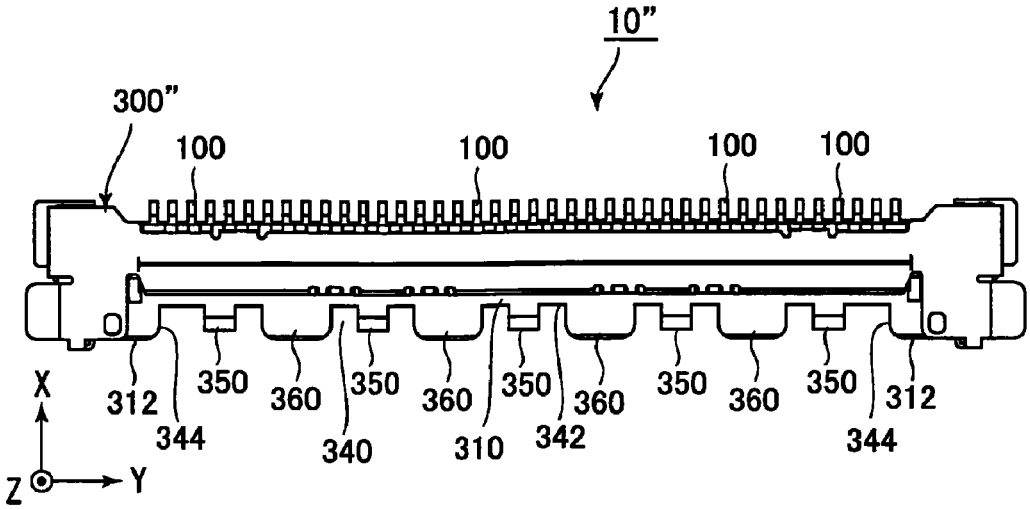
FIG. 7 is a plan view showing another variation of the connector of FIG. 2.

Specifically, each of the ground portions 350 projects frontward (toward the negative X-direction) from the inner back edge 342 of the recessed area 340. Each of the ground portions 350 of this embodiment has a front end that does not exceed the front edge 312 of the lower plate 310. In other words, the front end of the ground portion 350 is located between the front edge 312 and the inner back edge 342. Therefore, in the present embodiment, the entire structure of each ground portion 350 is located within the recessed area 340 as viewed downward (see FIG. 2). Any part of each ground portion 350 is not located outside of the recessed area 340. The ground portions 350 are soldered to a ground pattern (not shown) formed on the circuit board (not shown). The width of each ground portion 350 is greater than that of each contact 100 in the lateral direction. The number of the ground portions 350 is not limited to a specific value. For example, as shown in FIG. 6, three ground portions may be provided on a shell 300' of a connector 10'. Alternatively, as shown in FIG. 7, five ground portions may be provided on a shell 300" of a connector 10". The number of the ground portions 350 should be increased from the viewpoint of countermeasures against EMI.

Each of the stoppers 360 projects frontward (toward the negative X-direction) from the inner back edge 342 of the recessed area 340 as with the ground portions 350. When a mating connector (not shown) is to be inserted into the connector 10 erroneously upside down, the stoppers 360 receive a mating shell (not shown) of the mating connector for thereby preventing erroneous insertion of the mating connector into the connector 10. In order to prevent erroneous insertion of the mating connector into the connector 10 in rightward slant directions and leftward slant directions, it is preferable to arrange at least one stopper located within a left area of the recessed area 340 and at least one stopper located within a right area of the recessed area 340 with respect to the center of the recessed area 340 in the lateral direction. That is, it is preferable to provide at least two stoppers 360. The number of the stoppers 360 is not limited to a specific value. For example, as shown in FIG. 6, two stoppers may be provided on the shell 300' of the connector 10'. Alternatively, as shown in FIG. 7, four stoppers may be provided on the shell 300" of the connector 10".

Referring to FIGS. 3 and 5, the lower plate 310 of this embodiment includes a plurality of internal ground terminals 370 for establishing connection with the mating shell (not shown) within the receptacle portion 16. Specifically, each of the internal ground terminals 370 has an internal contacting portion 372 for establishing connection with the mating shell (not shown). Each of the internal ground terminals 370 extends rearward (toward the positive X-direction) or obliquely rearward (toward a composite direction of the positive X-direction and the positive Z-direction) from the lower plate 310 so that the internal contacting portion 372 is located within the receptacle portion 16 when the connector 10 has not been mated with the mating connector. The internal ground terminals 370 ensure contact between the shell 300 and the mating shell (not shown) and can shorten a distance from the ground portions 350 to a portion at which the shell 300 is connected to the mating shell (not shown). Accordingly, the EMI characteristics can further be improved.

As can be seen from FIG. 2, the upper plate 320 of this embodiment has a roughly hook-shape as viewed downward. The recessed area 340, the ground portions 350, and the stoppers 360 of the lower plate 310 are located in an area surrounded by three sides of the hook-shape of the upper plate 320. Therefore, the ground portions 350 do not overlap the upper plate 320. Thus, a soldered state can be viewed when the connector 10 is soldered to the circuit board (not shown). The upper plate 320 includes hold-downs 322 extending downward from opposite ends of the upper plate 320 in the lateral direction so as to have an L-shaped cross-section. The hold-downs 322 are soldered to the circuit board (not shown). Thus, the connector 10 is firmly fixed to the circuit board.

Each of the connection parts 330 according to the present embodiment connects the front end of the lower plate 310 near the right end (or the left end) of the lower plate 310 to the front end of the upper plate 320 near the right end (or the left end) of the upper plate 320. Therefore, even if part of the mating connector (not shown) abuts the shell 300 when the connector 10 is mated with the mating connector, the upper plate 320 is not curled by the mating connector.

In the aforementioned embodiment of the present invention, the ground portions 350 are provided on the front end 12 of the connector 10, i.e., on a side into which the mating connector is inserted. Therefore, it is possible to shorten a path from the circuit board to a portion at which the shell 300 is connected to the mating shell. Thus, it is possible to obtain high resistance to EMI. Furthermore, the ground portions 350 are provided in the recessed area 340, which is recessed rearward from the front edge 312 of the lower plate 310. Accordingly, the mating connector can be designed without consideration of the ground portions 350.

Furthermore, the ground portions 350 are soldered to the circuit board (not shown) near the front end 12 of the connector 10. Therefore, the connector 10 is firmly fixed to the circuit board (not shown) near the front end 12. Accordingly, it is possible to enhance resistance to unfavorable forces applied through the mating connector by urging of cables or the like. Thus, breakage due to such unfavorable forces can be prevented. Specifically, unfavorable forces may be applied to the connector 10, for example, when cables connected to the mating connector (not shown) are bent and moved. However, the connector 10 can be fixed to the circuit board (not shown)

near the front end 12, which is located closer to the mating connector (not shown), by soldering the ground portions 350 to the circuit board (not shown) on which the connector 10 is mounted and fixed. Therefore, according to the present embodiment, it is possible to enhance resistance to the aforementioned unfavorable forces.

Although the present invention has been described with specific examples, the present invention is not limited to the aforementioned embodiment. For example, as can be seen from a comparison of FIGS. 1, 6, and 7, the number of contacts 100 is not limited to a specific value.

Figure 8:
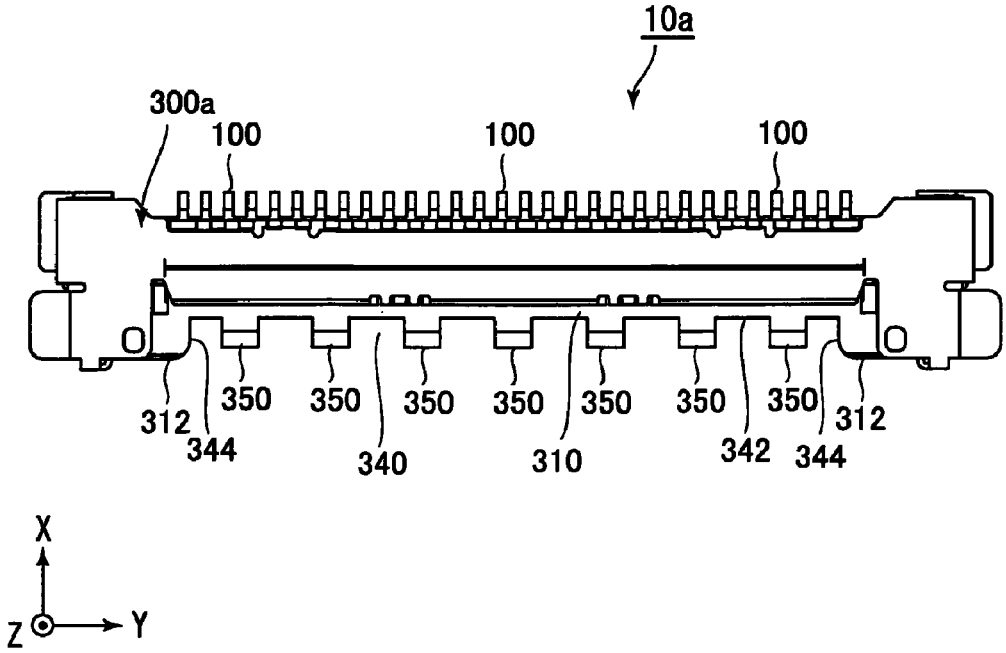
FIG. 8 is a plan view showing still another variation of the connector of FIG. 2.

In the connector 10 of the above embodiment, the ground portions 350 and the stoppers 360 are arranged alternately in the lateral direction. However, the present invention is not limited to this configuration. The ground portions 350 and the stoppers 360 may not be arranged alternately. Furthermore, the stoppers 360 may be dispensed with. Moreover, the resistance to EMI can further be improved if ground portions 350 are also arranged in a space produced by omission of the stoppers 360 as in a shell 300*a* of a connector 10*a* shown in FIG. 8.

According to the present invention, a lower plate of a shell has a recessed area recessed rearward from a front edge of the lower plate. A ground portion projects frontward within the recessed area. Therefore, a path from a circuit board to a portion at which the shell is connected to a mating shell can be shortened without design change of a mating connector while interference of the mating connector with the ground portion is avoided.

The present application is based on a Japanese patent application of JP2010-022537 filed before the Japan Patent Office on Feb. 3, 2010, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mountable on a circuit board and matable with a mating connector inserted from a front end of the connector toward a rear end of the connector, the connector comprising:

a plurality of contacts;

a holder for holding the plurality of contacts so that the plurality of contacts is arranged in a lateral direction; and a shell for covering at least part of the holder, the shell having a lower plate facing the circuit board when the connector is mounted on the circuit board, the lower plate including:

a front edge, an inner back edge located away from the front edge by a predetermined distance, inner side edges connecting the inner back edge to the front edge, the inner back edge and the inner side edges defining a recessed area recessed rearward from the front edge by the predetermined distance, and a ground portion projecting frontward from the inner back edge, the ground portion being connectable to the circuit board.

2. The connector as recited in claim 1, wherein the ground portion has an end located between the front edge and the inner back edge within the recessed area.

3. The connector as recited in claim 1, wherein the ground portion has a width greater than that of each of the plurality of contacts in the lateral direction.

4. The connector as recited in claim 1, wherein the shell has at least one stopper extending frontward from the inner back edge for receiving a mating shell of the mating connector to prevent the mating connector from being inserted erroneously upside down.

5. The connector as recited in claim 4, wherein the at least one stopper includes at least one stopper located within a left area of the recessed area and at least one stopper located within a right area of the recessed area with respect to a center of the recessed area in the lateral direction.

6. The connector as recited in claim 1, further comprising a receptacle portion for receiving a mating portion of the mating connector, wherein the shell has an internal ground terminal having an internal contacting portion located within the receptacle portion.

7. The connector as recited in claim 6, wherein the internal ground terminal extends rearward or obliquely rearward.

8. The connector as recited in claim 6, wherein the internal ground terminal extends from the lower plate.

9. The connector as recited in claim 1, wherein the shell has an upper plate for covering at least part of an upper surface of the holder, the upper plate has a hook-shape as viewed downward, the recessed area is located within an area surrounded by three sides of the hook-shape of the upper plate as viewed downward, and the ground portion does not overlap the upper plate as viewed downward.

10. The connector as recited in claim 2, wherein the shell has at least one stopper extending frontward from the inner back edge for receiving a mating shell of the mating connector to prevent the mating connector from being inserted erroneously upside down.

11. The connector as recited in claim 2, further comprising a receptacle portion for receiving a mating portion of the mating connector, wherein the shell has an internal ground terminal having an internal contacting portion located within the receptacle portion.

* * * * *